United States Patent [19]

Schmitt et al.

[11] 4,392,937

[45] Jul. 12, 1983

[54] ELECTROLYSIS CELL

[75] Inventors: Helmut Schmitt; Wolfgang Strewe, both of Dortmund; Helmuth Schurig, Holzwickede, all of Fed. Rep. of Germany

[73] Assignee: Uhde GmbH, Dortmund, Fed. Rep. of Germany

[21] Appl. No.: 372,099

[22] Filed: Apr. 26, 1982

[51] Int. Cl.[3] ..... C25B 9/04

[52] U.S. Cl. ..... 204/269; 204/279; 204/288; 204/275

[58] Field of Search ..... 204/279, 275–278, 204/253, 267–269, 288–289

[56] References Cited

U.S. PATENT DOCUMENTS

| | | | |
|---|---|---|---|
| 3,055,821 | 9/1962 | Holmes et al. | 204/270 |
| 4,014,776 | 3/1977 | Giacopelli | 204/270 X |
| 4,134,805 | 1/1979 | Frohler et al. | 204/269 X |
| 4,194,953 | 3/1980 | Hatherly | 204/269 X |
| 4,264,426 | 4/1981 | Kuusinen et al. | 204/289 X |

*Primary Examiner*—Donald R. Valentine

*Attorney, Agent, or Firm*—Wilson, Fraser, Barker & Clemens

[57] ABSTRACT

An electrolysis cell having an inlet and an outlet for transient electrolytes and including monopolar electrodes arranged in a staggered pattern such that the electrode plates of one polarity extend into the gaps formed between the electrode plates of the opposite polarity.

6 Claims, 3 Drawing Figures

ELECTROLYSIS CELL

BACKGROUND OF THE INVENTION

The present invention relates to an electrolysis cell consisting of a housing having an inlet and an outlet for the electrolyte passing through the cell. The housing accommodates monopolar electrodes, each of which consists of a number of parallel plates fixed to a common carrier element, and arranged in a staggered pattern so that the plates of one polarity extend into the gaps formed by the plates of the opposite polarity. At least one median electrode stack of one polarity with central electric power input is arranged between two electrode stacks of the opposite polarity.

The prior art includes monopolar cells of the design outlined above through which the electrolyte passes in a vertical direction and in which a multitude of electrode plates is arranged vertically in a monopolar pattern. The two outer electrode stacks are connected to the negative pole of a power source to serve as cathodes. These outer electrode plates are fixed to two carrier plates which serve as two side walls of the cell.

The plates are arranged in a vertical direction, equally spaced and parallel to one another. The inner electrode plates which constitute the median electrode stack are connected to the positive pole of a power source to serve as anodes.

The individual electrode plates are rectangular and are provided with two circular openings located symmetrically on the center line. The anode plates are fixed to two sleeves extending across the openings and are equally spaced, parallel to the longitudinal center lines of the sleeves. The cathode plates are rectangular in shape and have their free longitudinal edges provided with two semi-circular openings arranged so that a small annular gap is left between the sleeves and the cathode plates fixed to the two opposite carrier plates.

The cathode components are typically formed of steel, while the anode components are formed of titanium. The anode plates are coated with an activating layer of a known type on one or both sides.

The anode plates are lined up on one, or preferably several threaded stems, and are fixed in place by means of threaded sleeves and threaded rings. According to an embodiment of the invention with regard to the median electrode stack, the threaded sleeves are provided with annular crowns to which the anode plates with corresponding openings are welded.

While the cathode plate of the electrolysis cell of known design is free of mechanical problems, the cell is affected by certain disadvantages concerning the anode plates, i.e., the median electrode stack. The latter consists of a multitude of bolted components with more or less precise electric contact points which are sensitive to corrosion with consequent increased electrical resistance and voltage drops. The long threads and the areas of thin wall thickness of the threaded sleeve require complex fabrication procedures and are subject to distortion. The concentric power supply, for example, through two or three connecting bolts, is bound to entail an unfavorable distribution of current density across the rectangular electrode plate. Welding of the electrode plates to the threaded sleeve with annular crowns may easily cause warping because of the multiple concentric welded joints and this may, consequently, result in an irregular spacing of anode and cathode plates.

SUMMARY OF THE INVENTION

The aim of the present invention is to simplify the design of the median electrode stack and to achieve a more uniform current distribution from the power input element.

The objectives of the invention are typically an electrolysis cell consisting of a housing with one inlet and one outlet for the electrolyte passing through the cell, and accommodating monopolar electrodes, each of which consists of a number of parallel plates fixed to a common carrier element and arranged in a staggered pattern so that the plates of one polarity extend into the gaps formed by the plates of the opposite polarity. At least one median electrode stack of one polarity with central electric power input is arranged between two electrode stacks of the other polarity. The invention is particularly characterized in that the median electrode stack consists of a plurality of electrode plates and a current input plate of a length substantially equal to that of the electrode plates and a width substantially equal to that of the cell wherein the electrode plates are welded along one longitudinal side to the power input plate in a toothed pattern and the power input plate is joined to one side of wall of the cell housing and provided with at least one power input connection.

An electrolysis cell of the type according to this invention incorporates substantial advantages. The median electrode stack no longer has bolted joints and, therefore, no bolted contact points. Changes in electrical resistance with consequent voltage drop across corroding contact areas no longer occur. The number of components to be fabricated and shaped by metal-cutting operations is drastically reduced. The flow of electric current from the sole power input plate into the anode plates is uniform, and there is no increase in current density at any point.

The cell according to this invention permits cost-effective fabrication, is less subject to disturbances, and provides an improved energy yield because of the reduced voltage drop.

BRIEF DESCRIPTION OF THE DRAWINGS

The above as well as other objects and advantages of the invention will become readily apparent to one skilled in the art from reading the following detailed description of an embodiment of the invention when considered in the light of the accompanying drawings, in which.

DETAILED DESCRIPTION OF PREFERRED EMBODIMENT OF THE INVENTION

Figure 1:
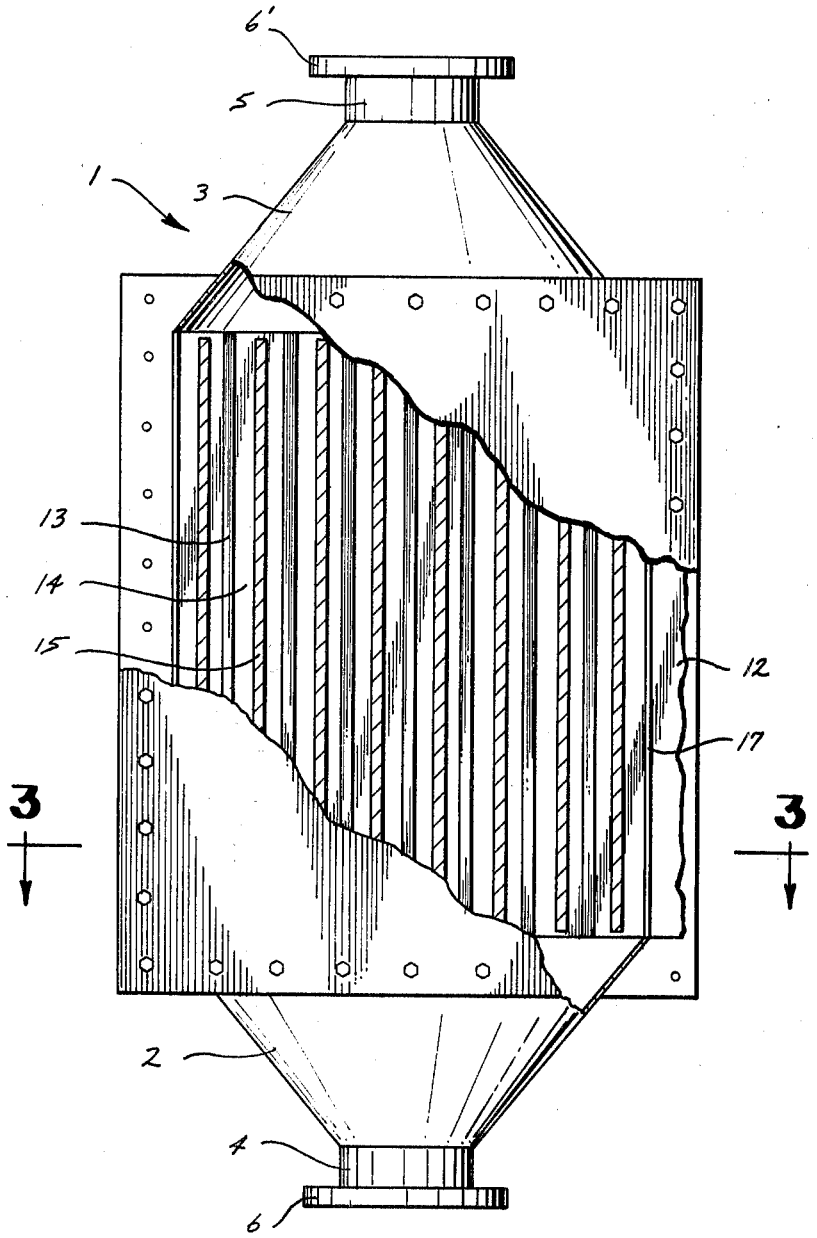
FIG. 1 is an elevational view of an electrolysis cell incorporating the features of this invention with portions broken-away to more clearly illustrate the structural details.
Figure 2:
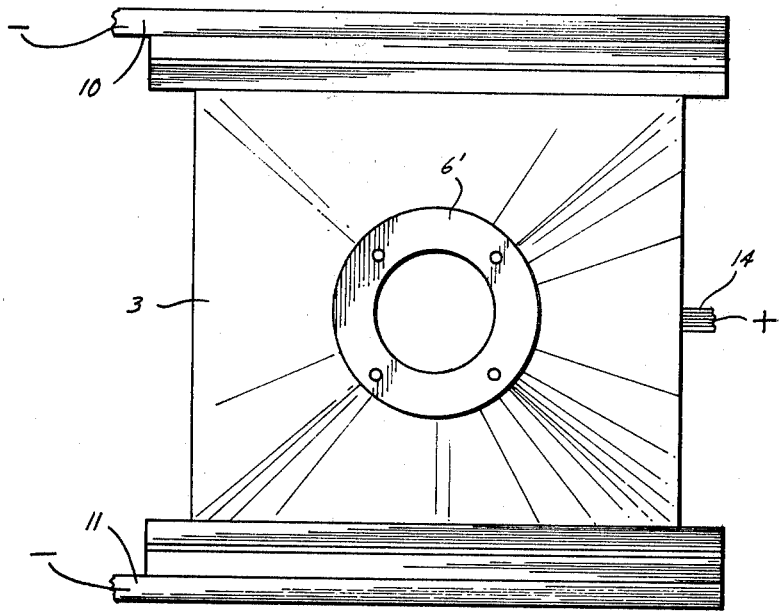
FIG. 2 is a top plan view of the electrolysis cell illustrated in FIG. 1.
Figure 3:
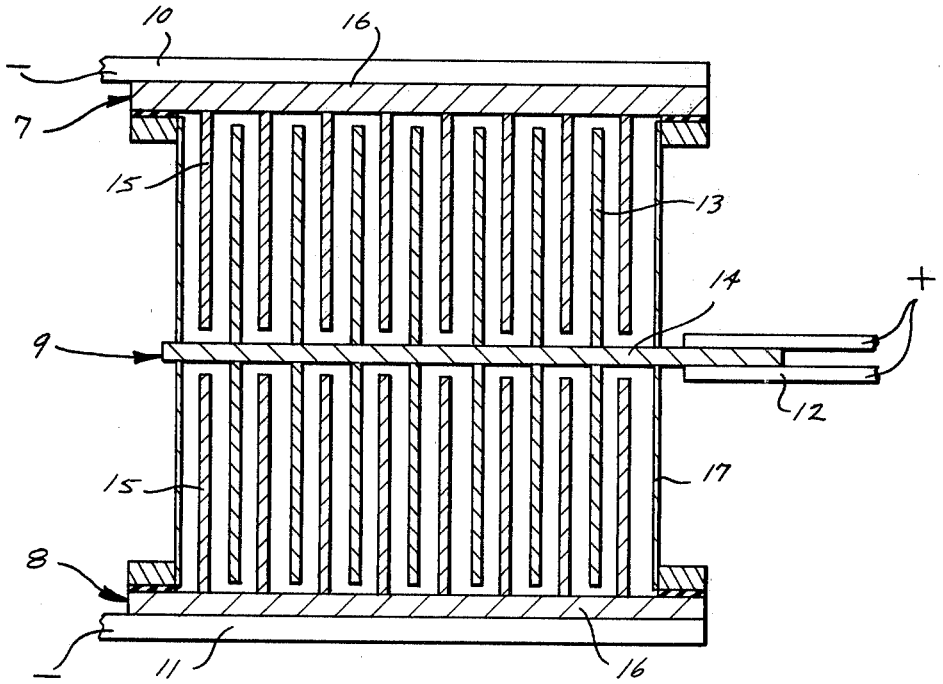
FIG. 3 shows a cross-sectional view of the electrolysis cell illustrated in FIGS. 1 and 2 taken along line 3—3 of FIG. 1.

The electrolysis cell as shown in FIG. 1 comprises a cell housing generally indicated by reference numeral 1 typically formed of titanium having a truncated cone-shaped bottom 2 and a truncated cone-shaped cover 3. The lower end of the bottom 2 terminates in an inlet nozzle 4. The top end of the cover 3 terminates in an outlet nozzle 5 for the electrolyte which passes through the cell from the bottom of the top thereof. The inlet nozzle 4 and the outlet nozzle 5 are each provided with a flange 6 and 6' for the connection to associated feed and discharge lines (not shown) for the electrolyte and the electrolysis products, respectively. The cell housing 1 accommodates three electrode stacks 7, 8 and 9, two of which are of the same polarity. The two outer electrode stacks 7 and 8 are connected to the negative pole of a power source by means of associated copper conductors 10 and 11 illustrated in FIGS. 2 and 3, which serve as cathodes, while the median electrode stack 9 located between the two cathodes 7 and 8 is connected to the positive pole of the power source by means of conductors 12 which serve as an anode.

The median electrode stack 9 is a compact anode stack comprising a plurality of anode plates 13 assembled on a power input plate 14. The cathode stacks 7 and 8 also include a number of cathode plates 15. The cathode plates 15 are disposed vertically and attached to one side of a carrier plate 16, equally spaced and parallel to one another. The carrier plates 16 serve at the same time as side walls of the cell housing 1. The plates 16 are electrically insulated from the other components of cell housing 1 to which they are attached, the joint being liquid-tight. The power input conductors 10 and 11 are fixed to the outside surfaces of carrier plates 16. All other parts of the cell housing 1 are electrically connected with the anode stack 9.

The anode plates 13 are rectangular in shape and are welded to the power input plate 14 on their longitudinal side. The plates 13 are spaced apart so that the cathode plates 15 fit into the gaps, while the necessary clearance is maintained. The cathode plates 15 also have straight internal sides without any recess. The current input plate 14 crosses the electrolysis cell and extends over the full height of the electrodes, i.e., the current transition from the input plate 14 to the electrodes is free of any restriction and, consequently, the current density is not subject to an increase.

According to a preferred embodiment of this invention, the internal side of wall 17 is also provided with an activating layer so that another anode side is incorporated.

All cathode components 7 and 8 are formed of steel, while all anode components 9 are formed of titanium. The anode plates 13 are provided with a standard activating layer on one side or on both sides. The power input plate 14 is formed of copper and is provided with titanium cladding throughout its entire internal part within the cell. The titanium cladding is welded to the cell housing 1 to form a liquid-tight seal between plate and cell wall. Outside the housing, the power input plate is connected to one or more current conductors.

We claim:

1. An electrolysis cell consisting of a housing with one inlet and one outlet for the electrolyte passing through the cell, said housing accommodating monopolar electrodes, each electrode consisting of a number of parallel plates fixed to a common carrier element, the electrodes being arranged in a staggered pattern so that the plates of one polarity extend into the gaps formed by the plates of the opposite polarity and at least one median electrode stack of one polarity with central electric power input is arranged between two electrode stacks of the other polarity, characterized in that the median electrode stack consists of a plurality of electrode plates and a power input plate of a length substantially equal to said plurality of electrode plates and a width substantially equal to that of the cell; said electrode plates being welded along one longitudinal side to said power input plate in a toothed pattern and said power input plate being joined to one side of wall of said cell housing and being provided with at least one power input connection.

2. An electrolysis cell according to claim 1, characterized in that said power input plate penetrates through the wall of the cell, and the power input plate being provided with at least one external power input connection.

3. An electrolysis cell according to claim 1, characterized in that said power input plate extends beyond the wall of the cell housing and is provided with several power input connections.

4. An electrolysis cell according to claim 1, characterized in that said power input plate is a copper plate with a cladding extending at least to all areas inside the cell to protect the surfaces wetted by the electrolyte.

5. An electrolysis cell according to claim 1, characterized in that said power input plate is seal-welded to the housing at the point of penetration through the housing wall.

6. An electrolysis cell according to claim 1, characterized in that the inside surface of wall of the cell is activated to obtain an additional electrode surface.

* * * * *